US008955475B2

(12) United States Patent
Yamazaki et al.

(10) Patent No.: US 8,955,475 B2
(45) Date of Patent: Feb. 17, 2015

(54) TWO-STROKE INTERNAL COMBUSTION ENGINE

(71) Applicant: Yamabiko Corporation, Tokyo (JP)

(72) Inventors: Takahiro Yamazaki, Tokyo (JP); Shirou Yamaguchi, Tokyo (JP); Ken Shirai, Tokyo (JP); Masaru Nozawa, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 0 days.

(21) Appl. No.: 14/185,941

(22) Filed: Feb. 21, 2014

(65) Prior Publication Data

US 2014/0238371 A1 Aug. 28, 2014

(30) Foreign Application Priority Data

Feb. 22, 2013 (JP) ..... 2013-032886

(51) Int. Cl.

| | |
|---|---|
| ***F02B 25/00*** | (2006.01) |
| ***F02B 75/02*** | (2006.01) |
| ***F02B 25/02*** | (2006.01) |
| ***F02B 25/16*** | (2006.01) |
| ***F02B 33/04*** | (2006.01) |

(52) U.S. Cl.

CPC ..... *F02B 75/02* (2013.01); *F02B 25/02* (2013.01); *F02B 25/16* (2013.01); *F02B 33/04* (2013.01); *F02B 2075/025* (2013.01)

USPC ..... 123/73 PP

(58) Field of Classification Search

CPC .... F02B 75/16; F02B 33/04; F02B 2075/025; F02B 25/02; F02B 75/02

USPC ..... 123/65 A, 65 PD, 65 P, 73 R, 73 PP

See application file for complete search history.

(56) References Cited

U.S. PATENT DOCUMENTS

| | | | | |
|---|---|---|---|---|
| 2,724,372 | A * | 11/1955 | Schowalter | 123/65 A |
| 3,059,626 | A * | 10/1962 | Froehlich et al. | 123/65 A |
| 5,813,373 | A * | 9/1998 | Schlossarczyk et al. | 123/65 P |

(Continued)

FOREIGN PATENT DOCUMENTS

| | | |
|---|---|---|
| EP | 2463495 A2 | 6/2012 |
| JP | 60-222522 | 7/1985 |

(Continued)

OTHER PUBLICATIONS

Extended European Search Report issued in corresponding European Patent Application No. 14156066.4 dated Oct. 9, 2014 (7 pages).

*Primary Examiner* — Hung Q Nguyen

(74) *Attorney, Agent, or Firm* — Kilyk & Bowersox, P.L.L.C.

(57) ABSTRACT

The scavenging passage includes a wall surface that defines an orientation direction of a main scavenging gas flow spouting from the scavenging port to the cylinder chamber. In a boundary portion between the scavenging port and the scavenging passage, a wall surface located on an opposite side of the exhaust port is composed of an inclined surface inclined in a direction further away from the exhaust port than a wall surface of a deep portion of the scavenging passage. The scavenging port includes a rear wall surface located in a portion on the opposite side of the exhaust port. The rear wall surface continues to the inclined surface to extend in the direction away from the exhaust port and generates an incidental scavenging gas flow incidental to the main scavenging gas flow and higher in speed than the main scavenging gas flow.

6 Claims, 12 Drawing Sheets

(56) References Cited

U.S. PATENT DOCUMENTS

| | | | |
|---|---|---|---|
| 6,289,856 | B1 | 9/2001 | Noguchi |
| 7,082,910 | B2 | 8/2006 | Carlsson et al. |
| 7,565,886 | B2 | 7/2009 | Carlsson et al. |
| 2001/0032602 | A1 | 10/2001 | Bergmann et al. |

FOREIGN PATENT DOCUMENTS

| | | |
|---|---|---|
| JP | 2001-173447 | 6/2001 |
| JP | 2008-274804 | 11/2008 |
| WO | 9857053 | 12/1998 |

* cited by examiner

TWO-STROKE INTERNAL COMBUSTION ENGINE

BACKGROUND OF THE INVENTION

1. Field of the Invention

The present invention generally relates to a two-stroke internal combustion engine and, more particularly, to an engine of a reverse scavenging type.

2. Description of the Related Art

Since the two-stroke internal combustion engine includes a small number of components and is small in size and weight, the two-stroke internal combustion engine is applied to portable or handheld working machines such as a brush cutter, a blower, and a chain saw. The two-stroke internal combustion engine of this type includes a scavenging passage connected to a cylinder chamber and a crank chamber. The scavenging passage is open to the cylinder chamber through a scavenging port. The scavenging port is opened and closed by a piston. As it is well known, the cylinder chamber is defined by a piston. A crankshaft is housed in the crank chamber, and a reciprocating motion of the piston is converted into a rotary motion by the crankshaft.

WO98/57053 (Patent Document No. 1) discloses a two-stroke internal combustion engine that uses fresh air for scavenging. The two-stroke internal combustion engine of this type is called "stratified scavenging type engine". Patent Document No. 1 discloses various stratified scavenging type engines. Specifically, the stratified scavenging type engine includes a gas mixture passage and a fresh air passage as an intake system of the engine. A gas mixture passing through the gas mixture passage is introduced into the crank chamber through a gas mixture port opened and closed by a piston.

The stratified scavenging type engine is classified into two types according to methods of introducing the fresh air into the scavenging passage. A first engine is an engine of a reed valve type. A second engine is an engine of a piston groove type. Patent Document No. 1 discloses the piston groove type engine.

The reed valve type engine includes a reed valve that controls the fresh air charged in the scavenging passage. A position of the reed valve in the engine will be explained. The fresh air passage merges with the scavenging passage in an upper part of the scavenging passage, that is, in a position near the scavenging port. The reed valve is arranged in this merging portion. In the reed valve type engine, when the piston ascends and the pressure in the crank chamber falls, the gas mixture flows into the crank chamber through the gas mixture passage and the reed valve opens. When the reed valve opens, the fresh air is fed from the fresh air passage to the scavenging passage.

When the gas mixture burns in the cylinder chamber, the piston descends with the combustion pressure in the cylinder chamber and the pressure in the crank chamber ascends. Halfway in the descent of the piston, that is, before the piston reaches the bottom dead center (BDC), an exhaust port opens according to the descent of the piston and, subsequently, the scavenging port opens. When the exhaust port opens, a combustion gas is discharged through the exhaust port. In a scavenging stroke in which the scavenging port opens, the fresh air accumulated in the upper part of the scavenging passage spouts to the cylinder chamber. The combustion gas remaining in the cylinder chamber is forced out to the outside through the exhaust port by the fresh air. In other words, the scavenging process is performed by the fresh air flowing into the cylinder chamber through the scavenging port.

The piston groove type engine includes a piston groove, through which the fresh air passes, on the outer circumferential surface of the piston. When the piston is located in a predetermined height position by moving up and down, the piston groove communicates with the fresh air passage and the scavenging port. The fresh air is fed from the fresh air passage to the scavenging passage via the piston groove by the communication. When the piston ascends and the pressure in the crank chamber falls, the gas mixture flows into the crank chamber through the gas mixture passage. The fresh air passage and the scavenging passage also communicate with each other through the piston grove, so that the fresh air flows into the scavenging passage.

Other precedents concerning the piston groove type engine are cited. U.S. Pat. No. 7,082,910 B2 (Patent Document No. 2), U.S. Pat. No. 7,565,886 B2 (Patent Document No. 3), and Japanese Patent Laid-Open No. 2001-173447 (Patent Document No. 4) disclose techniques for causing the fresh air passage and the scavenging passage to communicate with each other through the piston groove.

As a scavenging method for the two-stroke internal combustion engine, a "reverse scavenging" method is well known. Japanese Patent Laid-Open No. 60-222522 (Patent Document No. 5) discloses an engine of a Schnurle type, which is a typical example of the "reverse scavenging" method. Specifically, the Schnurle type engine disclosed in Patent Document No. 5 includes a pair of scavenging passages on the left and right when a cylinder bore is viewed in plan view. Scavenging ports of the respective scavenging passages are directed to the opposite side of exhaust ports.

In a scavenging stroke, gas spouted from the scavenging port into the cylinder chamber is directed in a direction away from the exhaust port. Then, the gas collides against a wall surface of the cylinder bore located on the opposite side of the exhaust port to be reversed and directed to the exhaust port. The "reversed scavenging method has an effect of, for example, suppressing so-called "blow-by" in which the gas mixture passes through the cylinder chamber without staying therein and is emitted to the outside from the exhaust port in a scavenging stroke.

Representative effects of the reverse scavenging type engine are illustratively listed below.

(1) "Blow-by of the gas mixture" is small in which a new gas mixture introduced into the cylinder chamber passes through the cylinder chamber without staying in the cylinder chamber. Therefore, scavenging efficiency is high and it is possible to improve a fuel consumption ratio.

(2) It is possible to reduce an amount of HC in an exhaust gas (improvement of emission).

(3) Since a plurality of pairs of scavenging ports can be provided, it is possible to expand a total capacity of the scavenging passages. Incidentally, Patent Document No. 5 discloses an engine including three pairs of scavenging ports.

Patent Document No. 5 discloses an invention having an object of reducing a blow-by loss of a gas mixture. The invention relates to a scavenging passage and proposes shaping of a wall surface of the scavenging passage into a specific shape. Specifically, the invention proposes a structure concerning a wall surface of a scavenging passage portion adjacent to a scavenging port. More specifically, when a cylinder chamber is viewed in plan view, according to the invention of Patent Document No. 5, it is proposed that a wall surface on a side close to an exhaust port in the wall surface of the scavenging passage portion adjacent to the scavenging port is composed of an inclined surface. According to the invention, a flowing direction of a scavenging gas passing through the scavenging passage is directed to the opposite side of the exhaust port near the scavenging port by the inclined surface. Consequently, a flow of the scavenging gas spouting from the scavenging port to the cylinder chamber is directed to a direction away from the exhaust port.

The blow-by loss of the gas mixture is an important technical problem considered to be a fate of the two-stroke internal combustion engine. Improvement of the blow-by loss of the gas mixture is directly linked to improvement of a fuel consumption ratio and improvement of emission. In particular, the recent environmental problem requests further improvement of the blow-by loss.

Therefore, it is an object of the present invention to provide a two-stroke internal combustion engine that can reduce the blow-by loss of the gas mixture.

SUMMARY OF THE INVENTION

Concerning the technical problem explained above, the inventors propose the present invention because the inventors were able to obtain, focusing on the shape of a scavenging port that is open to a cylinder chamber, a notable effect by applying a contrivance to the scavenging port.

The object of the present invention is attained by providing a two-stroke internal combustion engine including:

a cylinder bore formed in a cylinder;

a piston inserted into the cylinder bore to be reciprocatably movable, the piston defining a cylinder chamber in the cylinder bore;

a crankshaft configured to convert a reciprocating motion of the piston into a rotary motion;

a crank chamber configured to house the crankshaft and receive a gas mixture fed from an intake system;

a scavenging port that is open to the cylinder chamber and opened and closed by the piston;

a scavenging passage, one end of which ranges to the scavenging port and the other end of which is open to the crank chamber; and an exhaust port configured to exhaust a combustion gas in the cylinder chamber to the outside and opened and closed by the piston, wherein the scavenging passage includes a wall surface that defines an orientation direction of a main scavenging gas flow spouting from the scavenging port to the cylinder chamber, in a boundary portion between the scavenging port and the scavenging passage, a wall surface located on the opposite side of the exhaust port is composed of an inclined surface inclined in a direction further away from the exhaust port than a wall surface of a deep part of the scavenging passage, the scavenging port includes a rear wall surface located in a portion on the opposite side of the exhaust port, and the rear wall surface continues to the inclined surface to extend in the direction away from the exhaust port and generates an incidental scavenging gas flow incidental to the main scavenging gas flow and higher in speed than the main scavenging gas flow.

With the engine of the present invention, a scavenging gas in a portion far from the exhaust port in a scavenging gas spouting from the scavenging port to the cylinder chamber is changed to a flow close to a wall surface of the cylinder chamber by the inclined surface and the flow is relatively high in speed. The main scavenging gas flow spouting from the scavenging port can be attracted to the opposite side of the exhaust port by the relatively high-speed flow. According to this drawing effect, it is possible to reduce a "blow-by loss" in which a part of the scavenging gas spouting to the cylinder chamber directly flows into the exhaust port. In a preferred embodiment of the present invention, the inclined surface is composed of a curved surface having a convex shape toward the cylinder chamber.

In a preferred embodiment of the present invention, the scavenging port is composed of a main port portion directly continuing to the scavenging passage and a port extension forming a port extended passage extending in the lateral direction from the main port portion. The port extension extends from the main port portion to the opposite side of the exhaust port in a cylinder circumferential direction.

Further objects and action and effects of the present invention will be made obvious from detailed description of the preferred embodiments.

DETAILED DESCRIPTION OF THE PREFERRED EMBODIMENTS

A preferred embodiment of the present invention will be explained below on the basis of the accompanying drawings.

Figure 1:
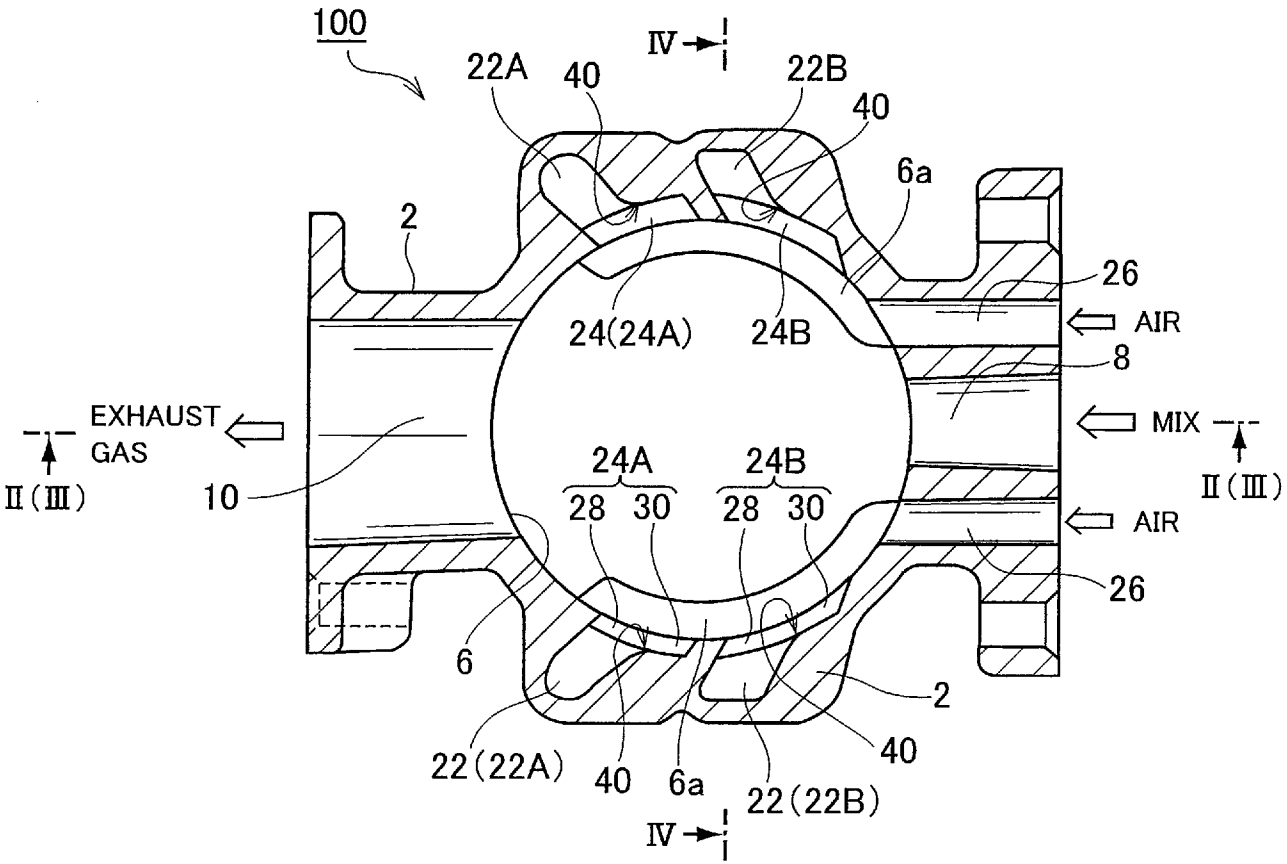
FIG. 1 is a cross sectional view of a two-stroke internal combustion engine in an embodiment.
Figure 2:
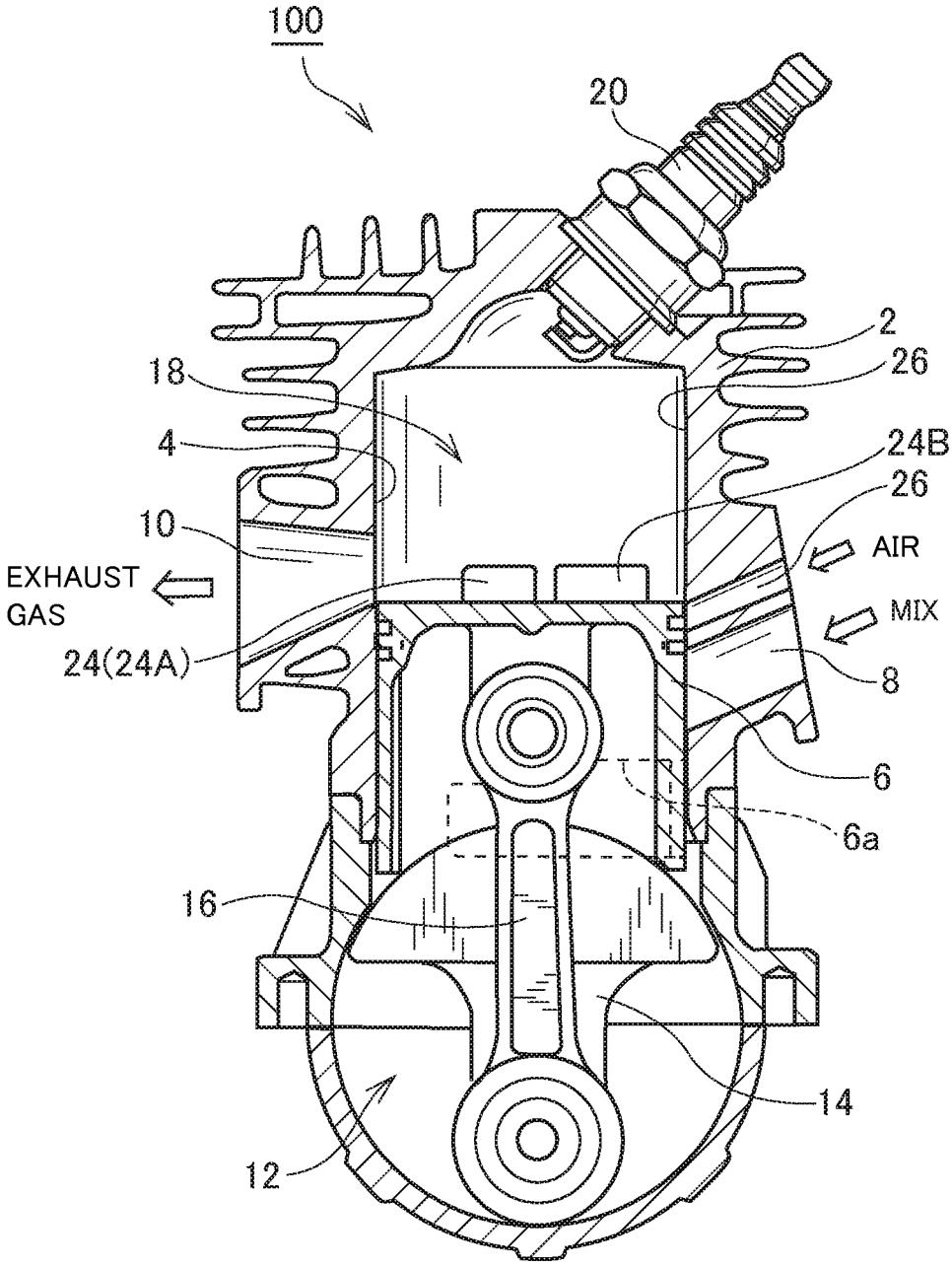
FIG. 2 is a longitudinal sectional view of the engine in the embodiment taken along line II-II in FIG. 1, wherein a piston is positioned at the bottom dead center (BDC)
Figure 3:
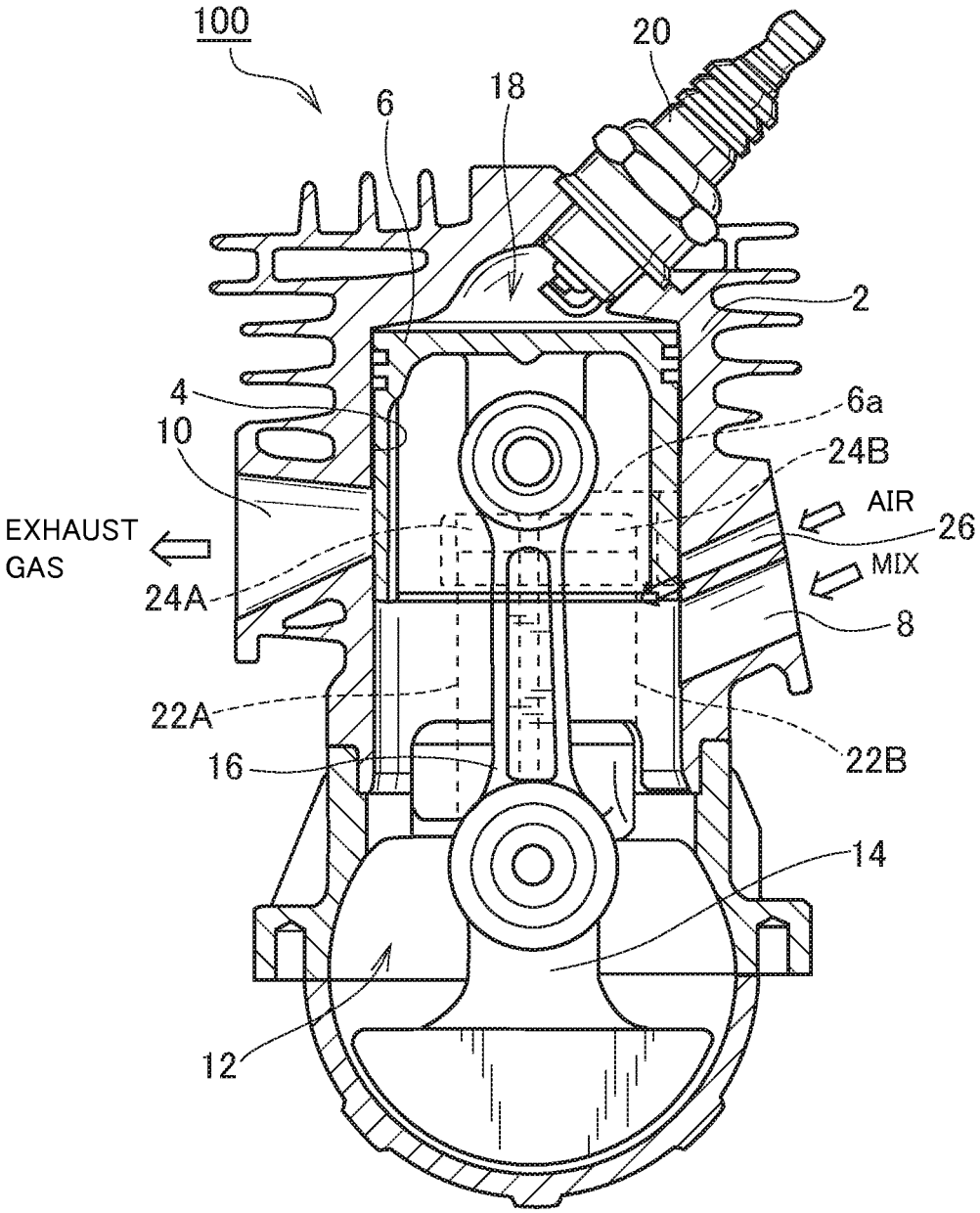
FIG. 3 is a longitudinal sectional view of the engine in the embodiment taken along line III-III in FIG. 1, wherein the piston is positioned at the top dead center (TDC)
Figure 4:
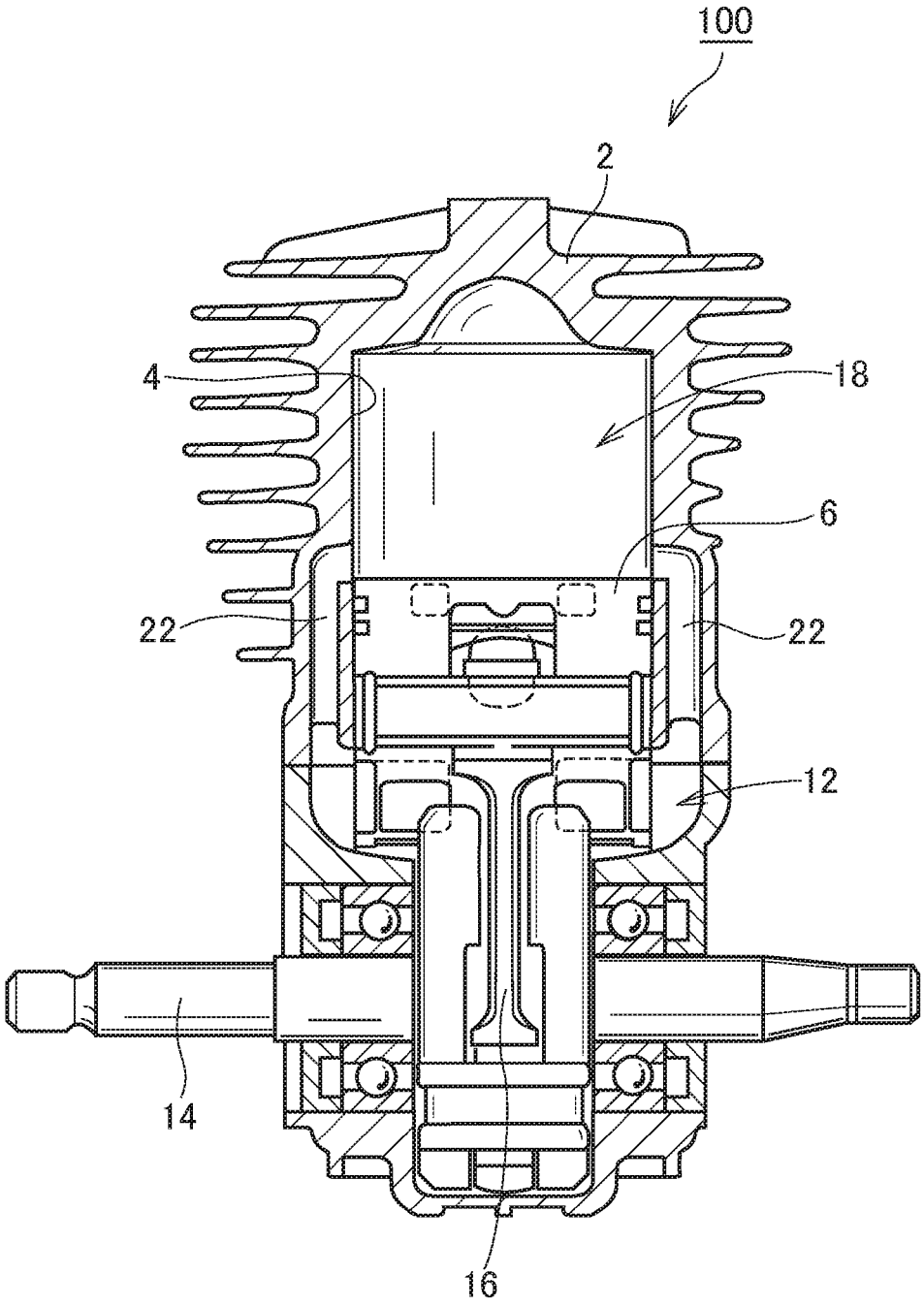
FIG. 4 is a longitudinal sectional view of the engine in the embodiment taken along line IV-IV in FIG. 1, wherein the piston is positioned at the bottom dead center.

FIGS. 1 to 6 are diagrams for explaining a first embodiment of an air-cooled two-stroke internal combustion engine 100, which shows an example in which the present invention is applied to a two-stroke internal combustion engine of a piston groove type. FIG. 1 is a cross sectional view of the engine 100. FIGS. 2 to 4 are longitudinal sectional views of the engine 100. Referring to FIGS. 2 to 4, reference numeral 2 denotes a cylinder and reference numeral 4 denotes a cylinder bore (FIG. 2). A piston 6 is inserted into the cylinder bore 4 and can move reciprocatably. The cylinder 2 includes, across the cylinder bore 4, a gas mixture port 8 located on one side of the cylinder bore 4 and an exhaust port 10 located on the other side. The gas mixture port 8 and the exhaust port 10 are opened and closed by the piston 6.

FIGS. 2 and 3 are longitudinal sectional views of the engine 100 taken along line II(III)-II(III) in FIG. 1. FIG. 2 shows a state in which the piston 6 is positioned at the bottom dead center (BDC). FIG. 3 shows a state in which the piston 6 is positioned at the top dead center. FIG. 4 is a longitudinal sectional view of the engine 100 taken along line IV-IV in FIG. 1.

As it is well seen from FIGS. 3 and 4, a crankshaft 14, which is an engine output shaft, is disposed in a crank chamber 12. The crankshaft 14 is coupled to the piston 6 via a coupling rod 16. A reciprocating motion of the piston 6 is converted into a rotary motion by the crankshaft 14. The piston 6 inserted into the cylinder bore 4 defines a cylinder chamber 18. An ignition plug 20 is attached to the top of the cylinder 2 to face the cylinder chamber 18.

Referring to FIG. 1, the cylinder 2 includes two pairs of scavenging passages 22 located on the left and right when viewed in plan view. The scavenging passages 22 on the left and right are respectively located between the gas mixture port 8 and the exhaust port 10 when the cylinder chamber 18 is viewed in plan view.

In FIG. 3, as indicated by a dotted line, the lower ends of the respective scavenging passages 22 are open to the crank chamber 12. The upper ends of the respective scavenging passages 22 communicate with scavenging ports 24. The scavenging port 24 is open to the cylinder chamber 18. With regard to the scavenging ports 24, first and second pairs of scavenging ports 24A and 24B are joined with the respective scavenging passages 22. The pairs of scavenging ports 24A and 24B are positioned side by side (FIGS. 1 and 2).

In the cylinder 2, a pair of fresh air ports 26 is formed on the left and right of the cylinder 2 across the gas mixture port 8. An intake system of the engine 100 includes an air cleaner, a carburetor, a gas mixture passage, and a fresh air passage, although not shown in the figures. A gas mixture generated by the carburetor is fed to the gas mixture port 8 through the gas mixture passage. Fresh air filtered by the air cleaner is fed to the pair of left and right fresh air ports 26 through the fresh air passage as in the conventional engine.

A pair of left and right air grooves 6*a* is formed on the circumferential surface of the piston 6 (FIGS. 1 to 3). When the piston 6 moves up and down, the air grooves 6*a* in the piston 6 makes or blocks communication between the fresh air ports 26 and the scavenging ports 24. The fresh air is fed to the scavenging passages 22 through the fresh air ports 26, the piston air grooves 6*a*, and the scavenging ports 24.

The operation of the air-cooled two-stroke internal combustion engine 100 is the same as the operation in the conventional engine. When the piston 6 descends in an expansion stroke, the exhaust port 10 opens and exhaust is started. The pressure in the crank chamber 12 rises according to the descent of the piston 6 and the scavenging ports 24 open following the exhaust port 10. Then, gas in the scavenging passages 22 spouts from the scavenging ports 24 into the cylinder chamber 18 with the pressure in the crank chamber 12 and the scavenging process is executed. When the piston 6 further descends, the gas mixture in the crank chamber 12 is supplied into the cylinder chamber 18 through the scavenging passage 22 and the scavenging port 24.

Subsequently, when the piston 6 ascends to enter a compression stroke, the pressure in the crank chamber 12 falls according to the ascent of the piston 6. The fresh air is fed to the scavenging passages 22 through the piston air grooves 6*a* and the scavenging port 24 and the gas mixture is filled in the crank chamber 12 through the gas mixture port 8 using the pressure fall in the crank chamber 12. Then, the gas mixture in the cylinder chamber 18 is compressed by the ascending piston 6. The ignition plug 20 is ignited immediately after the piston 6 reaches the top dead center (TDC).

Figure 5:
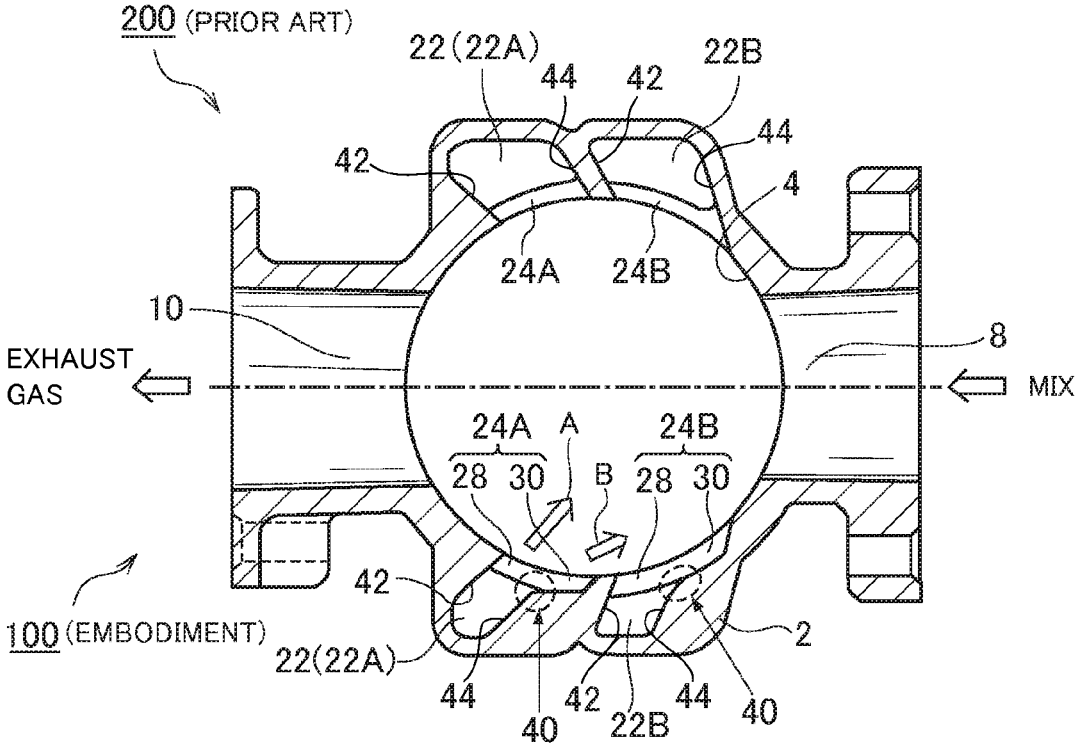
FIG. 5 is an explanatory diagram, the upper half of which shows the shape of a scavenging port of a conventional engine and the lower half of which shows a scavenging port of the engine in the embodiment.
Figure 6:
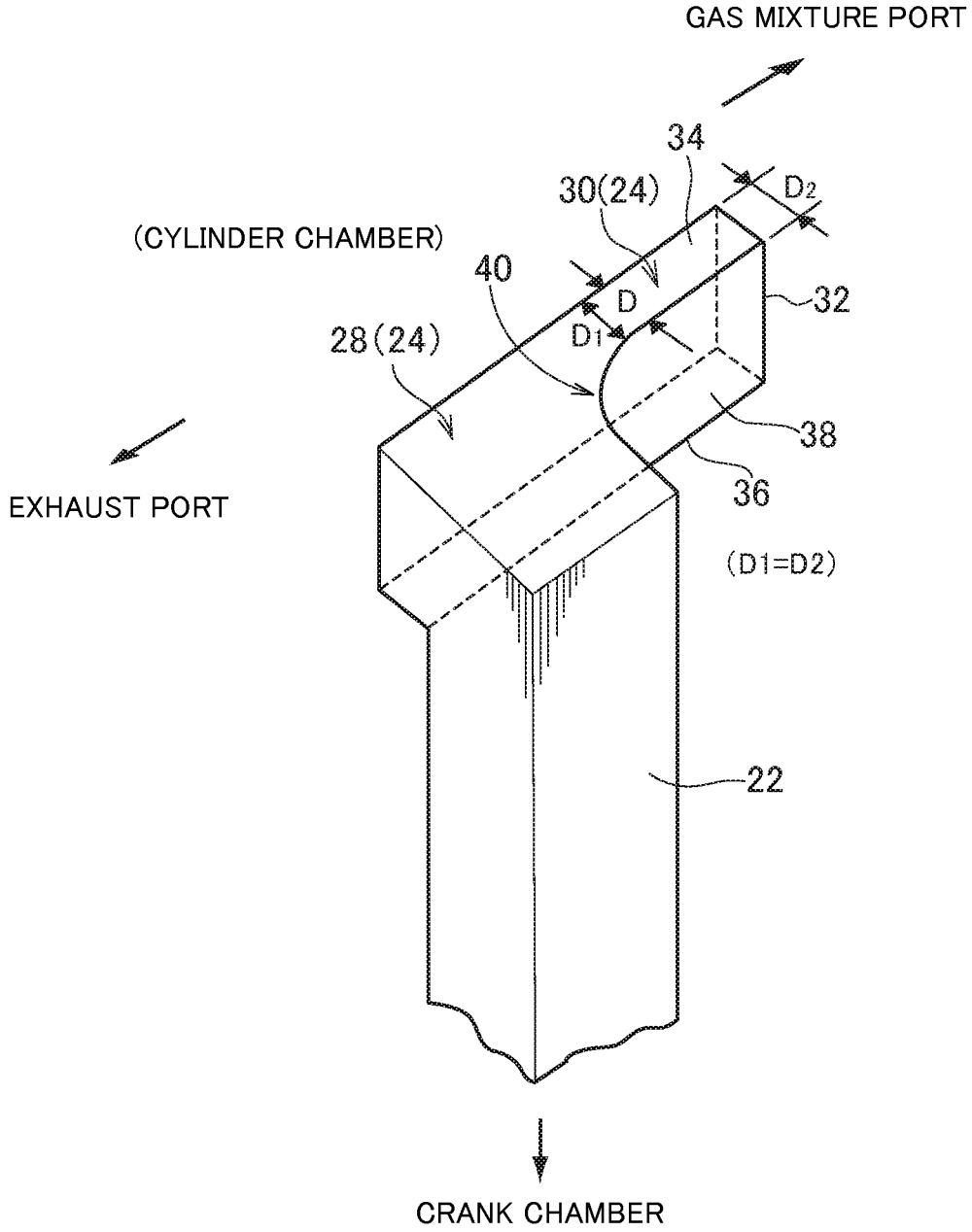
FIG. 6 is a diagram for explaining the shape of a scavenging passage of the engine in the embodiment, a main port portion of a scavenging port communicating with the scavenging passage, and a port extension extending in the lateral direction from the main port portion.

FIGS. 5 and 6 are diagrams for explaining the shape of the scavenging port 24. FIG. 5 is a cross sectional view of the cylinder. In FIG. 5, a conventional example (a comparative example) is illustrated on the upper side and the embodiment is illustrated on the lower side. FIG. 6 is a diagram for explaining the shape of the scavenging port 24 with the scavenging passage 22 and the scavenging port 24 extracted.

Referring to FIGS. 5 and 6, the scavenging port 24 is composed of a main port portion 28 directly ranging to the scavenging passage 22 and a port extension 30 extending from the main port portion 28 in the lateral direction, that is, the circumferential direction of the cylinder chamber 18. The port extension 30 extends to the opposite side of the exhaust port 10. In other words, the port extension 30 extends in the circumferential direction of the cylinder and to the side of the gas mixture port 8.

The port extension 30 has a passage shape defined by four wall surfaces 32, 34, 36, and 38 of the cylinder 2 (FIG. 6). Specifically, the port extension 30 extending to the side of the gas mixture port 8 configures a port extended passage defined by the end wall surface 32, the upper wall surface 34, the lower wall surface 36, and the rear wall surface 38 extending in the up and down direction.

A corner portion (a boundary portion) 40, where the port extension 30 and the scavenging passage 22 are in contact with each other, is composed of an inclined surface that gradually approaches the cylinder chamber 18 toward the gas mixture port 8. The inclined surface may be, as another preferred form, a flat surface or may be, as still another preferred form, a smoothly curved surface as indicated by the example shown in the figures.

Figure 7:
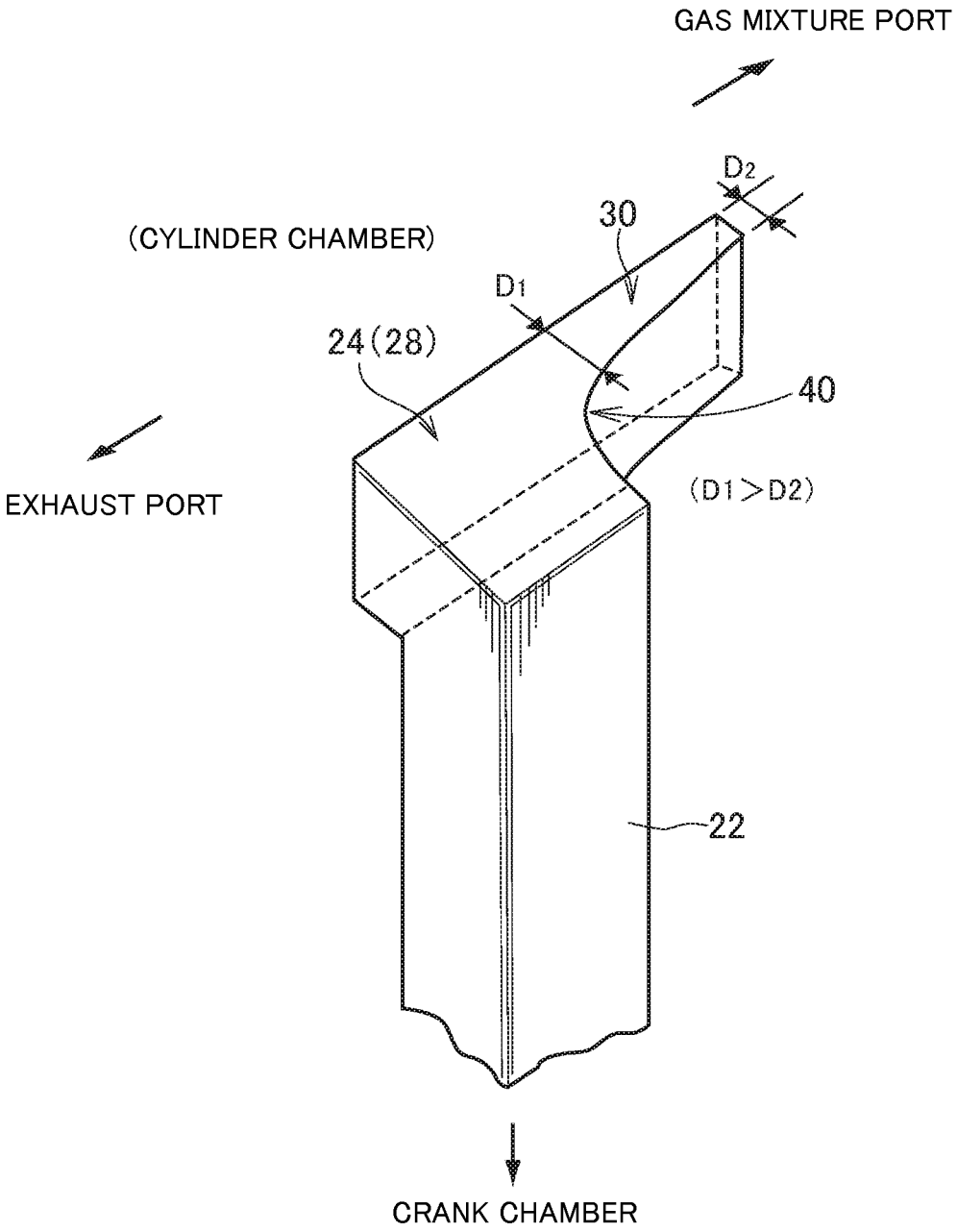
FIG. 7 is a diagram for explaining a modification of the port extension and is a diagram related to FIG. 6.

With regard to a passage depth dimension D (FIG. 6) of the port extension 30, depth D1 of a portion adjacent to the main port portion 28 is substantially equal to depth D2 of a portion on the side of the gas mixture port 8. As a modification, referring to FIG. 7, the depth D2 of the portion on the side of the gas mixture port 8 may be small compared with the depth D1 of the portion adjacent to the main port portion 28. In other words, the port extension 30 may have a passage shape that gradually shallows toward the gas mixture port 8.

Figure 8:
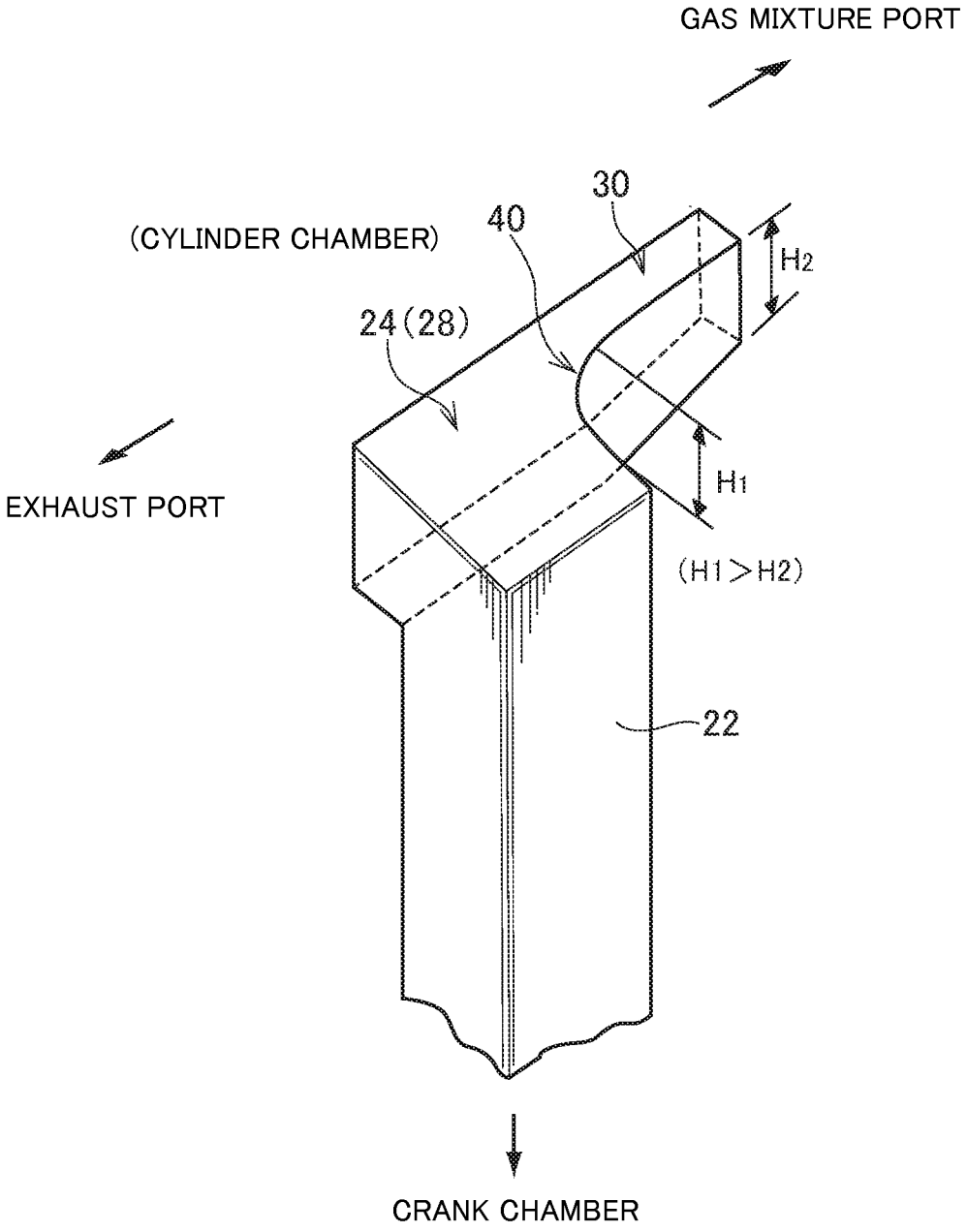
FIG. 8 is a diagram for explaining another modification of the port extension and is a diagram related to FIG. 6.

FIG. 8 shows another modification. As the shape of the port extension 30, a height dimension H2 of the portion on the side of the gas mixture port 8 may be small compared with a height dimension H1 of the portion adjacent to the main port portion 28. In other words, concerning a passage height dimension H of the port extension 30, the port extension 30 may have a shape tapered toward the gas mixture port 8. In an example shown in FIG. 8, the depth dimension D is the same over the entire length of the port extension 30. However, concerning the height dimension H, a tapered shape may be adopted in the modification explained with reference to FIG. 7 (the shape that shallows toward the gas mixture port 8).

Referring to the lower side of FIG. 5 showing the embodiment, the first and second scavenging ports 24A and 24B include first and second scavenging passages 22A and 22B communicating with the respective scavenging ports 24A and 24B. The first and second scavenging passages 22A and 22B may be composed of a common passage.

The embodiment shown in the figure including the first and second scavenging passages 22A and 22B will be explained. The engine 100 in the embodiment is an engine of a reverse scavenging type. The engine 100 is designed such that a scavenging gas spouting from the first and second scavenging ports 24A and 24B basically flows to the opposite side of the exhaust port 10 (oriented in a direction of an arrow A in FIG. 5).

Referring to the lower side of FIG. 5, when the cylinder 2 is viewed in plan view, at least a first sidewall 42 located on the side of the exhaust port 10 in the first scavenging passage 22A is composed of an inclined surface inclined toward the opposite side of the exhaust port 10. Preferably, a second sidewall 44 opposed to the first sidewall 42, that is, a sidewall on the gas mixture port 8 side is also composed of an inclined surface inclined toward the opposite side of the exhaust port 10. In the first scavenging port 24A communicating with the first scavenging passage 22A, the first sidewall 42 located on the side of the exhaust port 10 is composed of an inclined surface inclined toward the opposite side of the exhaust port 10. An orientation direction of a scavenging gas flow spouting to the cylinder chamber 18 is defined by this configuration.

The second scavenging passage 22B has the same configuration. The second scavenging port 24B communicating with the second scavenging passage 22B has the same configuration as the first scavenging port 24A. Therefore, these sidewalls are denoted by reference numerals used for the sidewalls 42 and 44 of the first scavenging passage 22A and the first scavenging port 24A and explanation of the sidewalls is omitted.

Referring to FIGS. 5 and 6, the end wall surface 32 of the port extension 30 is composed of an inclined surface inclined toward the gas mixture port 8 like the sidewalls 42 and 44 of the first and second scavenging passages 22A and 22B. As a modification, an inclination angle of the end wall surface 32 of the port extension 30 may be set larger than that of the sidewalls 42 and 44 of the first and second scavenging passages 22A and 22B. Specifically, the end wall surface 32 of the port extension 30 may be composed of an inclined surface greatly inclined toward the side of the gas mixture port 8.

The scavenging port 24 of the engine 100 in the embodiment includes, as explained above, the main port portion 28 directly communicating with the scavenging passage 22 and the port extension 30 extending from the main port portion 28 in the lateral direction. The port extension 30 extends to the opposite side of the exhaust port 10, that is, the side of the gas mixture port 8.

As explained above, the fresh air is fed to the scavenging port 24 and the scavenging passage 22 through the groove 6*a*, that is, a piston air groove formed on the circumferential surface of the piston 6. Therefore, in a scavenging stroke, first, the fresh air accumulated in the scavenging passage 22 spouts to the cylinder chamber 18 as a scavenging gas. Initial scavenging process of the cylinder chamber 18 is performed by the leading fresh air. Subsequently, scavenging process is performed by the gas mixture in the crank chamber 12.

As explained above, the scavenging port 24 is composed of the main port portion 28 and the port extension 30. A flow of a main scavenging gas spouting from the main port portion 28 to the cylinder chamber 18 is directed to the opposite side of the exhaust port 10 as in the prior art. This state is indicated by the arrow A on the lower side of FIG. 5.

The main port portion 28 directly communicates with the scavenging passage 22. On the other hand, the port extension 30 is defined by the walls 32, 34, 36, and 38 (FIG. 6). Consequently, the port extension 30 has a relatively small passage cross section. Therefore, a flow B of an incidental scavenging gas spouting to the cylinder chamber 18 through the port extension 30 is relatively high in speed compared with the main scavenging gas flow A spouting from the main port portion 28.

The relatively high-speed incidental scavenging gas flow B flowing out from the port extension 30 attracts the main scavenging gas flow A according to a Coanda effect (FIG. 5). Since the port extension 30 is located on the opposite side of the exhaust port 10, in an initial period of the scavenging stroke, according to the Coanda effect, the fresh air spouting from the scavenging port 24 to the cylinder chamber 18 flows to the opposite side of the exhaust port 10 as designed. Consequently, the scavenging by the fresh air is made more effective.

Following the scavenging by the fresh air, the gas mixture in the crank chamber 12 flows into the cylinder chamber 18 through the scavenging passage 22 and the scavenging port 24. At this time, the main scavenging gas flow A is also attracted to the opposite side of the exhaust port 10 according to the Coanda effect by the incidental scavenging gas flow B. Consequently, it is possible to reduce the "blow-by loss" in which a part (the gas mixture) of the main scavenging gas flow A flows into the exhaust port 10.

When the piston 6 moves up from the bottom dead center (BDC), the internal pressure of the crank chamber 12 falls. In the process in which the piston 6 ascends, as explained above, the fresh air is fed to the scavenging passage 22 through the piston air groove 6*a* and the scavenging port 24. As the scavenging port 24 includes the port extension 30 extending laterally from the main port portion 28, which directly communicates with the scavenging passage 22, the fresh air can be smoothly filled in the scavenging passage 22 from the piston air groove 6*a* through the scavenging port 24.

In the embodiment, as explained above, the corner portion 40 (the boundary portion), where the port extension 30 and the scavenging passage 22 are in contact with each other, is composed of the inclined surface that gradually approaches the cylinder chamber 18 toward the gas mixture port 8. Consequently, the scavenging gas smoothly flows into the port extension 30 from the scavenging passage 22. A flowing direction of the scavenging gas flowing into the port extension 30 can be directed to the longitudinal direction of the port extension 30, which configures the port extended passage, that is, to the side of the gas mixture port 8.

As it is best seen from FIG. 6, the corner portion 40 composed of the inclined surface is preferably composed of a curved surface. Consequently, the scavenging gas more smoothly flows into the port extension 30 from the scavenging passage 22.

Consequently, a flowing direction of the scavenging gas flowing into the port extension 30 from the scavenging passage 22 is directed to the longitudinal direction of the port extension 30, that is, to the side of the gas mixture port 8. The scavenging gas imparted with the directivity spouts from the port extension 30 to the cylinder chamber 18. Therefore, a flowing direction of the high-speed incidental scavenging gas flow B spouting from the port extension 30 incidentally to the main scavenging gas flow A tends to approach the wall surface of the cylinder chamber 18. The main scavenging gas flow A spouting from the main port portion 28 is deflected to a direction approaching the wall surface of the cylinder chamber 18 by the high-speed incidental scavenging gas flow B flowing to the direction approaching the wall surface of the cylinder chamber 18 (FIG. 5). This means that an effect of further improving the effect of reducing the "blow-by loss" can be expected.

Referring to FIG. 5, an engine 200 of the conventional example (the comparative example) is drawn on the upper side of FIG. 5. Components or elements same as that of the engine 100 in the embodiment are denoted by the same reference numerals and the conventional engine 200 will be explained. As it is immediately seen when the upper side (the comparative example) and the lower side (the embodiment) of FIG. 5 are compared, the first and second scavenging ports 24A and 24B respectively communicating with the first and second scavenging passages 22A and 22B in the conventional engine 200 correspond to the main port portion 28 of the engine 100 in the embodiment.

When the inventors conducted an experiment to confirm an effect of the engine 100 in the embodiment, compared with the conventional example drawn on the upper side of FIG. 5, the engine 100 in the embodiment had a fuel consumption reducing effect of about 4% and a reducing effect of HC in an exhaust gas of about 17%.

Figure 9:
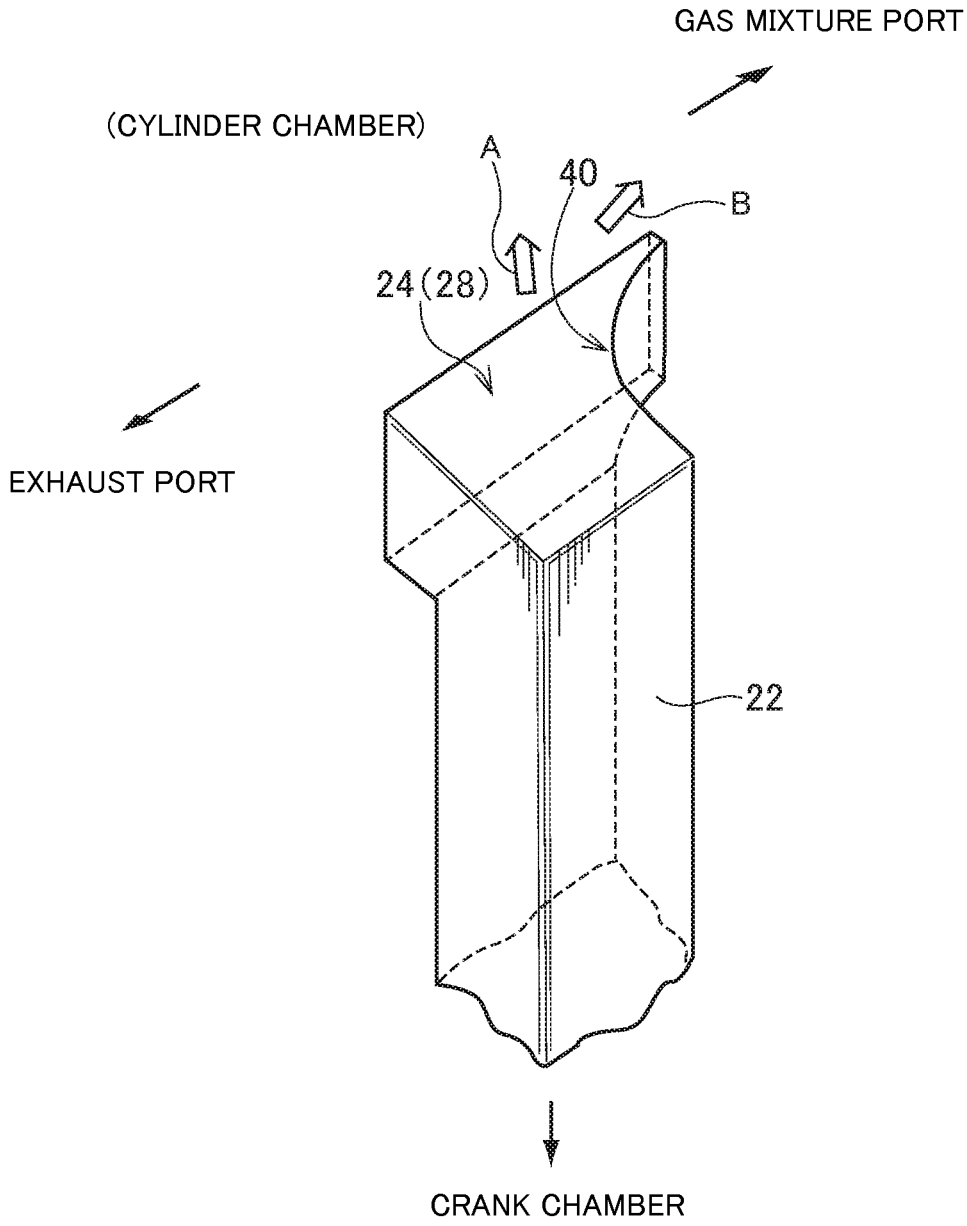
FIG. 9 is a diagram corresponding to FIG. 6 for explaining another embodiment concerning the scavenging port.

FIG. 9 shows another embodiment concerning the shape of the scavenging port 24. FIG. 9 is a diagram corresponding to FIG. 6. Referring to FIG. 9, the scavenging port 24 is composed of the main port portion 28 ranging to the scavenging passage 22. In a boundary portion between the scavenging passage 22 and the scavenging port 24, the corner portion 40 is formed in a boundary portion between a portion of the scavenging port 24 on the opposite side of the exhaust port 10 and a wall surface of the scavenging passage 22 on the opposite side of the exhaust port 10 ranging to the portion. In other words, the scavenging port 24 has a shape gradually expanding to the side of the gas mixture port 8 toward the cylinder chamber 18. In the scavenging port 24 having the shape expanding to the side of the gas mixture port 8, the inclined corner portion 40 is formed in the boundary portion between the wall surface of the scavenging passage 22 on the side of the gas mixture port 8 and the wall surface of the scavenging port 24. The corner portion 40 is preferably composed of a curved surface having a convex shape to the cylinder chamber 18 as shown in the figure.

Figure 10:
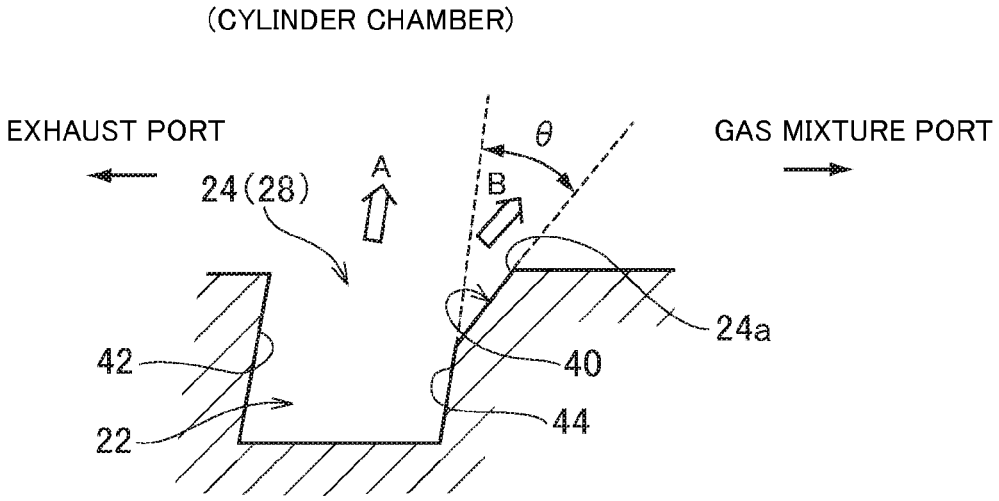
FIG. 10 is a plan view for explaining inclination of a corner portion (a boundary portion) between the scavenging passage and the scavenging port ranging to the scavenging passage.
Figure 11:
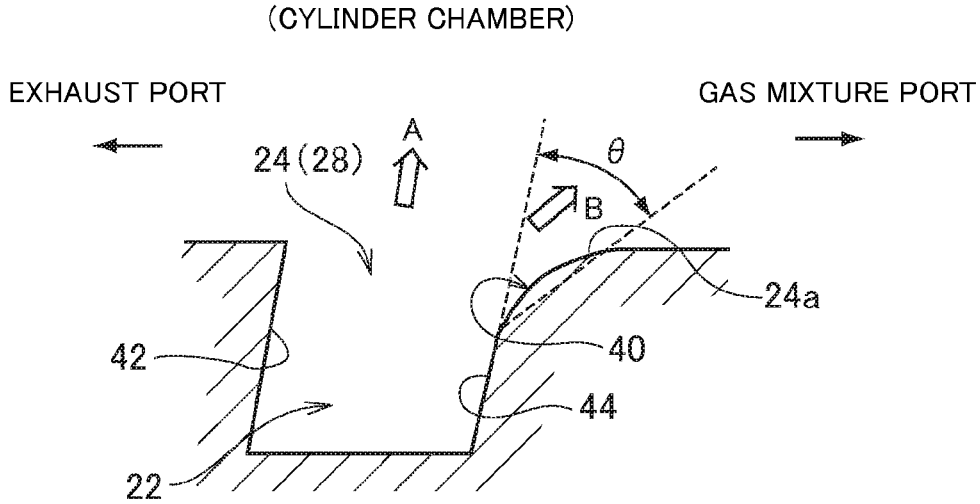
FIG. 11 is a diagram for explaining the corner portion (the boundary portion) shown in FIG. 9 and is a plan view of an example in which an inclined surface configuring the corner portion is composed of a curved surface having a convex shape toward a cylinder chamber.

FIG. 10 is a plan view for explaining the corner portion 40 (the boundary portion) composed of the inclined surface. FIG. 11 is a plan view of an example in which the inclined surface of the corner portion 40 is composed of a curved surface. Referring to FIG. 10, the corner portion 40 is inclined in a direction away from the exhaust port 10 with respect to an extending direction toward the cylinder chamber 18 of the wall surface 44 located on the opposite side of the exhaust port 10 of the scavenging passage 22. Specifically, the corner portion 40 is further inclined than the inclination of the wall surface 44 in a deep portion of the scavenging passage 22, that is, a portion far from the cylinder chamber 18. An angle of the further inclination of the corner portion 40 is indicated by "θ". The extending direction toward the cylinder chamber 18 of the wall surface 44 located on the opposite side of the exhaust port 10 of the scavenging passage 22 substantially defines a basic spouting direction of the scavenging gas flow defined by the scavenging passage 22 and the scavenging port 24. The spouting direction of the scavenging gas flow is equivalent to the orientation direction of the main scavenging gas flow A in the embodiment explained with reference to FIGS. 1 to 9.

It goes without saying that the rear wall surface 38 of the scavenging port 24 ranging to the corner portion 40 continues to the inclined surface of the corner portion 40. That is, the scavenging port 24 includes the rear wall surface 38 continuing to the corner portion 40 and extending in a direction away from the exhaust port 10. Therefore, the scavenging port 24 continuing to the corner portion 40 composed of the inclined surface in the boundary portion between the scavenging passage 22 and the scavenging port 24 has a shape expanding to the opposite side of the exhaust port 10.

Referring to FIG. 11, when the inclined surface of the corner portion 40 (the boundary portion) is composed of the curved surface having the convex shape toward the cylinder chamber 18, the rear wall surface 38 of the scavenging port 24 ranging to the corner portion 40 also continues to the curved inclined surface of the corner portion 40 and extends in the direction away from the exhaust port 10.

The "inclined surface" has been explained above with reference to FIGS. 10 and 11. This explanation can be applied to the embodiment explained with reference to FIGS. 1 to 9, that is, the embodiment in which the scavenging port 24 is composed of the main port portion 28 and the port extension 30.

In the other embodiment shown in FIG. 9, as in the embodiment explained above, the incidental scavenging gas flow B on the side close to the gas mixture port 8 (the opposite side of the exhaust port 10) in the scavenging gas spouting from the scavenging port 24 is relatively high in speed compared with the main scavenging gas flow A on the side close to the exhaust port 10. Therefore, the main scavenging gas flow A on the side close to the exhaust port 10 is deflected to the direction approaching the wall surface of the cylinder chamber 18 according to the Coanda effect based on the relatively high-speed incidental scavenging gas flow B incidental to the main scavenging gas flow A and on the side close to the gas mixture port 8. Consequently, it is possible to improve the reduction effect of the "blow-by loss".

Figure 12:
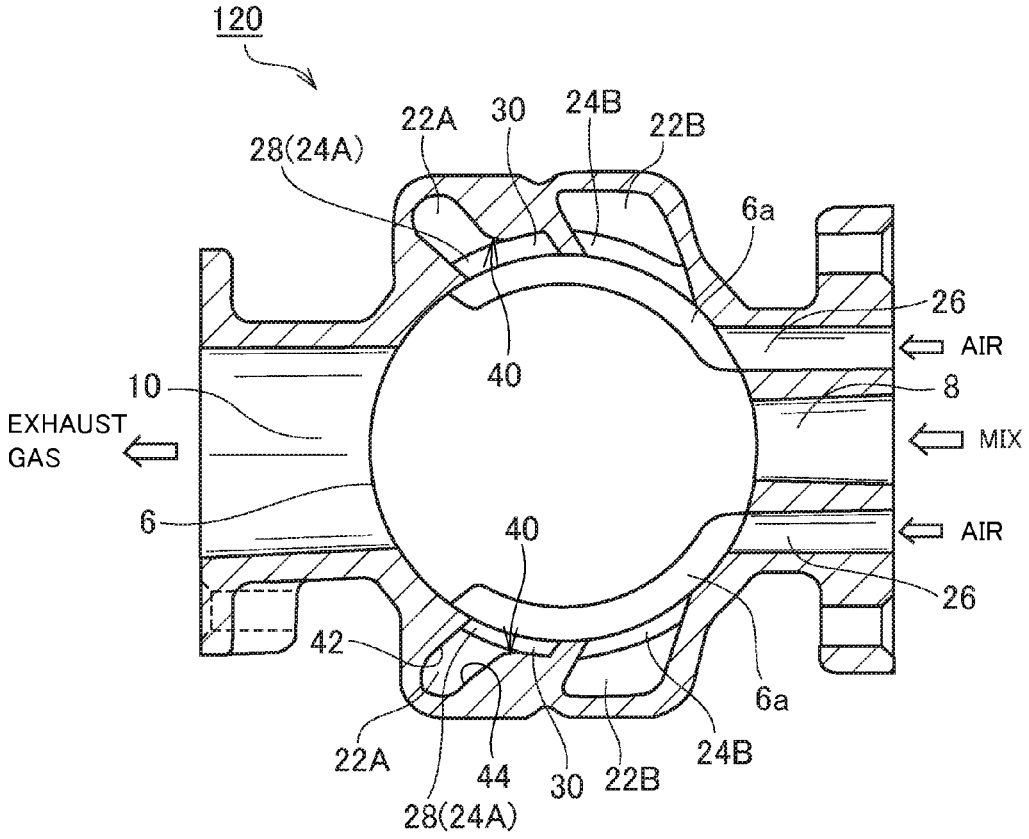
FIG. 12 is a diagram showing a modification of the two-stroke internal combustion engine in the embodiment and is a diagram related to FIG. 1.

FIG. 12 shows an engine 120 in a modification of the first embodiment. In the engine 120, the first scavenging port 24A located near the exhaust port 10 is composed of the main port portion 28 and the port extension 30. However, the second scavenging port 24B located near the gas mixture port 8 has a port shape that directly communicates with the second scavenging passage 22B as in the prior art. The engine 120 in this modification can has effects same as that of the engine 100 in the first embodiment. It goes without saying that the scavenging port 24 in the other embodiment shown in FIG. 9 and the conventional scavenging port may be combined.

The embodiment of the present invention has been explained above with reference to the air-cooled engine 100 of the stratified scavenging and reverse scavenging type as the example. However, the present invention is not limited to the embodiments. In the embodiments, the engine 100 includes the two scavenging ports 24A and 24B on one side. However, the number of the scavenging ports 24 is not limited. The engine may include one scavenging port 24 on one side or three scavenging ports 24 on one side (see Patent Document No. 5).

Concerning the arrangement of the scavenging ports 24, when the cylinder bore 4 is viewed in plan view, the scavenging ports 24 may be arranged symmetrically on the left and right or may be arranged asymmetrically.

Figure 13:
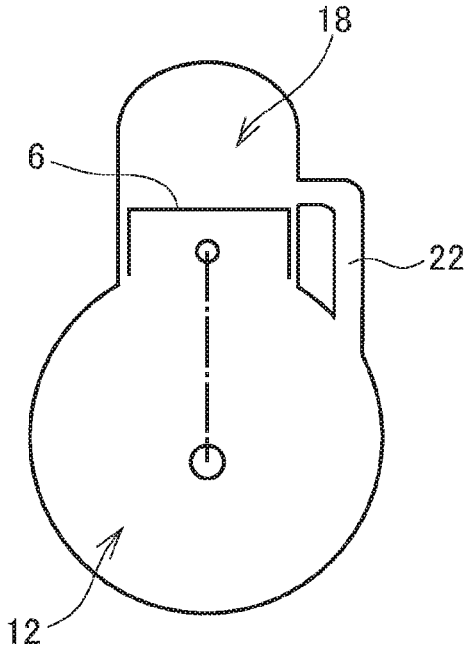
FIG. 13 is a diagram for specifically explaining an application example of the present invention.
Figure 14:
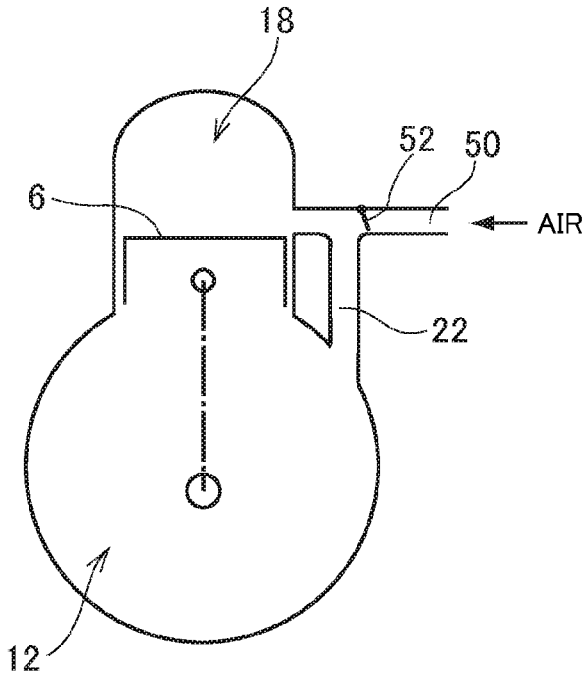
FIG. 14 is a diagram for specifically explaining another application example of the present invention.

As shown in FIG. 13, the present invention can also be effectively applied to an engine of a type for performing scavenging only with the gas mixture in the crank chamber 12 (an engine of a scavenging type that does not use the fresh air). Further, as shown in FIG. 14, the present invention can also be applied to an engine of a type in which a reed valve 52 is interposed between a fresh air passage 50 of an intake system and the scavenging passage 22.

In the engine 100 of the embodiment, the gas mixture port 8 and the exhaust port 10 are arranged in positions opposed to each other in a diameter direction across the cylinder chamber

18. As the two-stroke internal combustion engine, there is also an engine in which the gas mixture port 8 and the exhaust port 10 are located on the same side. The present invention can also be effectively applied to this type of engine.

In the engine 100 in the embodiment, the exhaust port 10 is arranged on one side of the cylinder chamber 18 and the fresh air port 26 is arranged on the other side of the cylinder chamber 18. As the two-stroke internal combustion engine, there is known an engine in which the fresh air port 26 and the exhaust port 10 are arranged on the same side. The present invention can also be effectively applied to this type of engine.

The present invention can be widely applied to the two-stroke internal combustion engine. Typically, the present invention can be effectively applied to working machines, in particular, portable or handheld working machines such as a brush cutter, a blower, and a chain saw.

While the invention has been described with reference to the specific embodiment, it will be apparent to those skilled in the art that various changes and modifications can be made to the specific embodiment without departing from the spirit and scope of the invention as defined in the claims.

REFERENCE NUMERALS LIST

100 Air-cooled two-stroke internal combustion engine in the embodiment
2 Cylinder
4 Cylinder bore
6 Piston
6*a* Air groove (piston grooves)
8 Gas mixture port
10 Exhaust port
12 Crank chamber
14 Crankshaft
18 Cylinder chamber
22 Scavenging passage
24 Scavenging port
26 Fresh air port
28 Main port portion of the scavenging port
30 Port extension of the scavenging port
32 End wall surface (port extension)
34 Upper wall surface (port extension)
36 Lower wall surface (port extension)
38 Rear wall surface (port extension)
40 Corner portion (boundary between the extension and the scavenging passage)
A Main scavenging gas flow
B Incidental scavenging gas flow

What is claimed is:

1. A two-stroke internal combustion engine comprising:
a cylinder bore formed in a cylinder;
a piston inserted into the cylinder bore and can move reciprocatably, the piston defining a cylinder chamber in the cylinder bore;
a crankshaft configured to convert a reciprocating motion of the piston into a rotary motion;
a crank chamber configured to house the crankshaft and receive a gas mixture fed from an intake system;
a scavenging port that is open to the cylinder chamber and opened and closed by the piston;
a scavenging passage, one end of which ranges to the scavenging port and the other end of which is open to the crank chamber; and
an exhaust port configured to exhaust a combustion gas in the cylinder chamber to an outside and opened and closed by the piston, wherein
the scavenging passage includes a wall surface that defines an orientation direction of a main scavenging gas flow spouting from the scavenging port to the cylinder chamber,
in a boundary portion between the scavenging port and the scavenging passage, a wall surface located on an opposite side of the exhaust port is composed of an inclined surface inclined in a direction further away from the exhaust port than a wall surface of a deep portion of the scavenging passage,
the scavenging port includes a rear wall surface located in a portion on the opposite side of the exhaust port, and
the rear wall surface continues to the inclined surface to extend in the direction away from the exhaust port and generates an incidental scavenging gas flow incidental to the main scavenging gas flow and higher in speed than the main scavenging gas flow.

2. The two-stroke internal combustion engine according to claim 1, wherein the inclined surface is composed of a curved surface having a convex shape toward the cylinder chamber.

3. The two-stroke internal combustion engine according to claim 1, wherein
the scavenging port is composed of a main port portion directly continuing to the scavenging passage and a port extension forming a port extended passage extending in a lateral direction from the main port portion, and
the port extension extends from the main port portion to the opposite side of the exhaust port in a cylinder circumferential direction.

4. The two-stroke internal combustion engine according to claim 1, wherein the two-stroke internal combustion engine is an engine of a reverse scavenging type in which a scavenging gas spouting from the scavenging port to the cylinder chamber is directed to the opposite side of the exhaust port.

5. The two-stroke internal combustion engine according to claim 1, wherein the two-stroke internal combustion engine is an engine of a stratified scavenging type in which fresh air spouts from the scavenging port to the cylinder chamber in an initial period of a scavenging stroke.

6. The two-stroke internal combustion engine according to claim 5, wherein
the cylinder further includes a fresh air port that receives feeding of the fresh air from the intake system, and
the piston includes a piston groove that can make communication between the fresh air port and the scavenging port.

* * * * *